US011749082B2

(12) United States Patent
Wass

(10) Patent No.: US 11,749,082 B2
(45) Date of Patent: Sep. 5, 2023

(54) FIRE OR SMOKE DETECTOR

(71) Applicant: APOLLO FIRE DETECTORS LIMITED, Havant (GB)

(72) Inventor: Kevin Mark Wass, Havant (GB)

(73) Assignee: APOLLO FIRE DETECTORS LIMITED, Havant (GB)

( * ) Notice: Subject to any disclaimer, the term of this patent is extended or adjusted under 35 U.S.C. 154(b) by 0 days.

(21) Appl. No.: 17/635,173

(22) PCT Filed: Jun. 24, 2020

(86) PCT No.: PCT/GB2020/051523
§ 371 (c)(1),
(2) Date: Feb. 14, 2022

(87) PCT Pub. No.: WO2021/032941
PCT Pub. Date: Feb. 25, 2021

(65) Prior Publication Data

US 2022/0270459 A1 Aug. 25, 2022

(30) Foreign Application Priority Data

Aug. 16, 2019 (GB) ..... 1911792

(51) Int. Cl.
*G08B 17/113* (2006.01)
*G08B 29/18* (2006.01)

(52) U.S. Cl.
CPC ..... *G08B 17/113* (2013.01); *G08B 29/18* (2013.01)

(58) Field of Classification Search
CPC .... G08B 17/113; G08B 17/107; G08B 17/10; G08B 17/00; G08B 29/145; G08B 17/06; G08B 29/18; G01N 21/53; A62C 3/16
See application file for complete search history.

(56) References Cited

U.S. PATENT DOCUMENTS 5,926,098 A * 7/1999 Wiemeyer ..... G08B 17/113 340/630
6,377,182 B1 * 4/2002 Devine ..... G08B 17/113 340/630

(Continued)

FOREIGN PATENT DOCUMENTS

CN 103906391 A 7/2014
CN 105517391 A 4/2016

(Continued)

OTHER PUBLICATIONS

International Preliminary Report on Patentability for PCT/GB2020/051523, dated Sep. 29, 2021, in 7 pages.

(Continued)

*Primary Examiner* — Muhammad Adnan
(74) *Attorney, Agent, or Firm* — Procopio, Cory, Hargreaves & Savitch LLP

(57) ABSTRACT

A smoke or fire detector is described for mounting on a ceiling. A first part (110) is for mounting on the ceiling and a second part (110) houses a detector. The second part has a top-plate (116) with an annular recess. Electrical connections are arranged above the recess. A pair of drains (111) are provided through a surface of the recess, with conduits (113) extending downwards from the drains. The annular recess directs condensation to the drains (111) and down through the conduits (113), away from the electrical connections. In use, a differential air pressure between a ceiling void above and a lower surface of the smoke or fire detector provides a stack effect to assist drainage of condensation.

18 Claims, 2 Drawing Sheets

(56) References Cited

U.S. PATENT DOCUMENTS

| | | | | |
|---|---|---|---|---|
| 2004/0145483 | A1* | 7/2004 | Pilkington | G08B 17/113 340/628 |
| 2008/0087035 | A1* | 4/2008 | Kim | B60H 1/3233 62/285 |
| 2010/0206048 | A1* | 8/2010 | Locke | G08B 17/00 73/31.03 |
| 2012/0235822 | A1* | 9/2012 | Barson | G08B 17/113 340/630 |
| 2013/0008787 | A1* | 1/2013 | Mammoto | G08B 17/10 204/415 |
| 2015/0097679 | A1* | 4/2015 | Andrews | G08B 17/113 340/628 |
| 2015/0254954 | A1 | 9/2015 | Andrews et al. | |
| 2015/0302727 | A1* | 10/2015 | Piccolo, III | G08B 17/107 340/514 |
| 2015/0310732 | A1* | 10/2015 | Piccolo, III | G08B 29/145 340/515 |
| 2021/0041350 | A1* | 2/2021 | Takano | G08B 17/107 |
| 2022/0268753 | A1* | 8/2022 | Sobol | G01N 33/1853 |

FOREIGN PATENT DOCUMENTS

| | | | | |
|---|---|---|---|---|
| CN | 105517391 B | * | 1/2019 | |
| JP | 2003-248877 A | | 9/2003 | |
| JP | 2013-008082 A | | 1/2013 | |
| JP | 2013-008084 A | | 1/2013 | |
| JP | 2013008082 A | * | 1/2013 | G08B 17/107 |

OTHER PUBLICATIONS

International Search Report and Written Opinion for PCT/GB2020/051523, dated Sep. 30, 2020, in 13 pages.

Search Report under Section 17 for GB1911792.8, dated Jan. 29, 2020, in 4 pages.

Notification of Grant for GB1911792.8, dated Sep. 21, 2021, in 2 pages.

Examination Report and Notification of Intention to Grant under Section 18(4) for GB1911792.8, dated Jul. 1, 2021, in 2 pages.

* cited by examiner

FIRE OR SMOKE DETECTOR

FIELD OF THE INVENTION

This invention relates to a smoke or fire detector, particularly of a ceiling-mounted type.

BACKGROUND

A common problem faced with smoke or fire detectors is the accumulation of condensation in and on the device. Water can be found in ceiling voids primarily due to condensation. Detectors powered by mains or connected to a wired network may necessarily have exposed wires on the top surface of a ceiling mount. Accumulated condensation may enter the detector and short out electrical connections. In addition to creating short circuits, condensation resting on an optical detector may scatter light travelling into the detector. This may increase or decrease the intensity of the light and create a false positive or negative reading in the detector.

Air pressure variation from either side of a ceiling void can affect the performance of a smoke detector. If the pressure above the ceiling is greater than below, clean air could be blown into the sensing chamber of a detector or across the smoke entry point and delay or prevent an alarm condition. A solution is to seal the back of the detector to prevent air passing. This prevents water from effectively draining. Any water build-up in this area will short the base terminals.

JP 20138084 A describes water outlets that are above and radially outward from the air inlets and are not ideal, as incoming air may draw water with it into the device. More particularly, air or water exiting from such holes can interfere with smoke ingress into the smoke detector.

CN 105517391 A describes a smoke detector having a casing and, inside the casing, a labyrinth cover provided with draining holes and recess portions. Water is guided from diversion grooves to draining grooves, into recess portions and out though draining holes. An issue that can arise in this device is that without a sufficient head of pressure to drain the recess portions through the draining holes, draining holes may become clogged (for example with mould from stagnant water). The labyrinth cover may begin to fill with water, which can be directed towards electronic or detector components resulting in device failure. Another issue is that airflow through the detector (i.e. from a wall cavity or ceiling cavity through the device and into a room of lower pressure) out from the draining holes can interfere with smoke entering through the smoke entry areas in casing, resulting in a false negative. The arrangement is not clear, but it also appears that pressure in the other direction may suck water exiting from the labyrinth cover into the device, or at least such water may impede entry of smoke through some of the inlets in the casing such that the device may fail the "stack effect" test.

SUMMARY

According to the present invention, a smoke or fire detector for mounting on a ceiling is provided comprising; a first part having at least one first electrical connection on a lower surface thereof and a second part having an annular recess. At least one second electrical connection is arranged above the annular recess and at least one drain is provided through a surface of the annular recess. At least one conduit extends downwards from the drain. A smoke or fire detecting means within the second part; the first part configured to receive the second part, wherein; the annular recess may direct condensation to the at least one drain (111) and into the at least one conduit (113), away from the first (102) and second (115) electrical connections. In use, a differential air pressure between an upper surface of the smoke or fire detector and a lower surface of the smoke or fire detector provides a stack effect to assist fluid flow in the at least one conduit.

A mere water drain between the base and detector does not allow enough head of pressure to build to drain effectively, due to water surface tension. The conduits, by extending downwards, provide additional head of water.

The drain channel drives any air pressure from above the ceiling void away from the smoke entry path in a controlled manner whilst allowing sufficient pressure to build with water to drain effectively, without the need for expensive seals.

The first part preferably has at least one first electrical connection for engaging in the second part such that the first and second electrical connections make contact with one another when the second part is received by the first part.

Plastic interlocking elements may be provided for holding the first and second parts together.

The at least one first electrical connection and the at least one second electrical connection may provide the fastening means for holding the first and second parts together. This ensures a good electrical connection.

There is preferably a third part (a cover) arranged to be received by and cover a lower surface of the second part. The third part has openings to allow smoke to enter the detector and reach the sensor.

A bottom surface of the third part preferably contains at least one exhaust arranged to receive the at least one conduit of the second part. The at least one conduit preferably protrudes beyond the bottom surface of the third part (e.g. the third part provides an extension to the conduit or the conduit extends through a hole in the third part). There may be a plurality of such conduits (preferably two but up to four).

A detailed description of a smoke or fire detector for mounting on a ceiling provided in the embodiments of the present disclosure will be described below with reference to the accompanying drawings.

FIGURES

DETAILED DESCRIPTION

Figure 1:
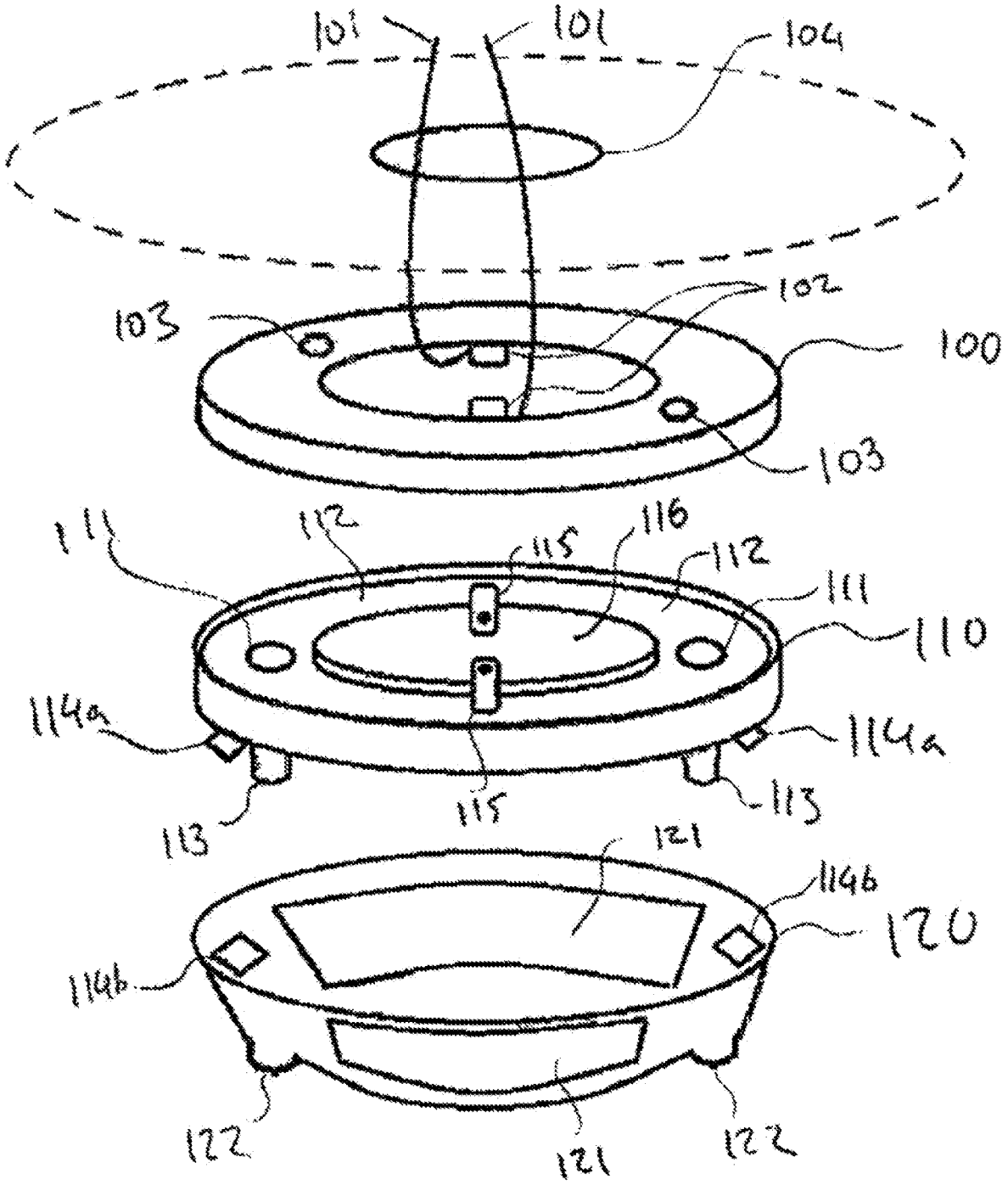
FIG. 1 is a schematic diagram, in exploded view, of a smoke or fire detector for mounting on a ceiling according to the present disclosure.

As illustrated in FIG. 1, in an embodiment, the smoke or fire detector includes a ceiling mount 100 having mounting holes 103 for securing the ceiling mount 100 to a ceiling. The ceiling mount 100 further comprises at least a pair of first electrical connectors 102 on a lower surface thereof, for connecting to connecting wires 101. When installed, the connecting wires 101 may connect the first electrical connectors 102 to a wired communication network (not shown) or to the positive and negative terminals of a power supply (not shown).

The smoke or fire detector comprises a detector housing part 110 that has a top-plate 116. The detector housing part 110 has a pair of second electrical connectors 115. It also has an annular recess 112 (recessed downwards vis-à-vis a peripheral lip and also vis-à-vis the top-plate 116).

Annular recess 112 has two drain holes 111 (but may have fewer or more) and corresponding conduits 113 which extend vertically downwards from the respective drain holes 111. References here and hereafter to "holes", "conduits" and the like include the singular.

The ceiling mount 100 is configured to receive detector housing part 110. The ceiling mount 100 and detector housing part 110 are secured together. They may be secured together by a bayonet fastening arrangement or by snap fit fasteners. Preferably, plastic elements co-operate to hold the parts together, and the electrical connectors remain connected by spring action of the metal parts. The plastic elements may be keyed to ensure correct orientation of parts. In an alternative arrangement, they are secured together by the first and second electrical connectors 102 and 115 in a bayonet-fit. In other words, by locating the lower part over the upper part and twisting, the respective electrical connectors engage and it is the electrical connectors themselves that hold the parts in engagement. This has an advantage over other interoperating plastic fastening parts, in that it ensures that the connectors are always fully connected.

The detector housing part 110 has smoke, gas or fire detecting circuitry (not shown) mounted on a lower surface and connected to the second electrical connectors 115.

The smoke or fire detector has a covering part 120. The covering part 120 has one or more peripheral openings (i.e. windows, holes or spaces) 121 that allow smoke to enter the detector. (In the case of a single opening, this could go all the way around the covering part, with a central pillar or other support to support the covering part 120 to the detector housing part 110.)

The detector housing part 110 is configured to receive the covering part 120. The detector housing part 110 is preferably secured to the covering part 120 by screws that extend vertically through detector housing 110 and into covering part 120. Alternatively, fasteners 114*a* and 114*b* may be provided to secure detector housing part 110 and covering part 120 together. These are preferably snap-fit fasteners with some means for releasing (e.g. a hole into which a tool may be inserted to release the snap part).

The covering part 120 further comprises one or more exhaust ports 122, each configured to receive a corresponding conduit 113 of the detector housing part 110.

Recess 112 permits any condensation on a top surface of the device to build-up in the recess, below the level of electrical connections 115 and 102. Recess 112 directs such condensation away from electrical components thus reducing the probability of a short circuit.

Drain holes 111 permit such condensation to drain out of the recess 112.

In normal operation, stack effect can cause differential air pressure between the top of the detector and the bottom of the detector. Airflow through the device is managed by the exhaust ports 122 so that clean air from the ceiling void above does not blow smoke away from the openings 121 under such differential pressure. Conduits are long so that the airflow may be transported from the top of detector (in the region of the annular recess 112) to the bottom of the detector, away from the openings 121.

In addition, the conduits 113 are elongated about 12 mm to 40 mm long and preferably about 18 mm long, such that water that collects in them has a head of pressure (of about 12-18 mm). This head of pressure is sufficient to overcome surface tension at the exhaust ports 122 and cause the water to flow out. The diameter of the conduit is selected according to its length. The smaller the diameter, the longer the length required to build enough pressure to overcome surface tension of the water. A larger diameter conduit will require a shorter conduit length. The intended diameter is preferably in the range of about 3 mm to 6 mm.

The conduits 113 extend below the lower level of the covering part 120 in the form of chimneys. This gives greater head of water pressure than would otherwise be provided by mere drain holes.

The conduit chimneys are removed from the openings 121 so that smoke from a fire or smoking source enters the openings 121 that lead to the detector, without excessive mixing from clean air that might vent out from above through the chimneys.

It may be noted that, when installed in a ceiling, the conduit(s) 113 provide a route for air from a ceiling cavity to vent out below the lower covering part 120, bypassing the detector. Thus, air from above does not impede entry of smoke that may be circulating across a ceiling, as in a stack effect test and in a typical fire.

In particular, the exhaust ports 122 (chimneys or otherwise) of the conduits 113 are below the openings 121. Preferably they are radially inward from those openings 121 and there are no other openings below or inward from the exhaust ports 122 for air, smoke or gas to access the smoke, gas or fire detecting circuitry.

Figure 2:
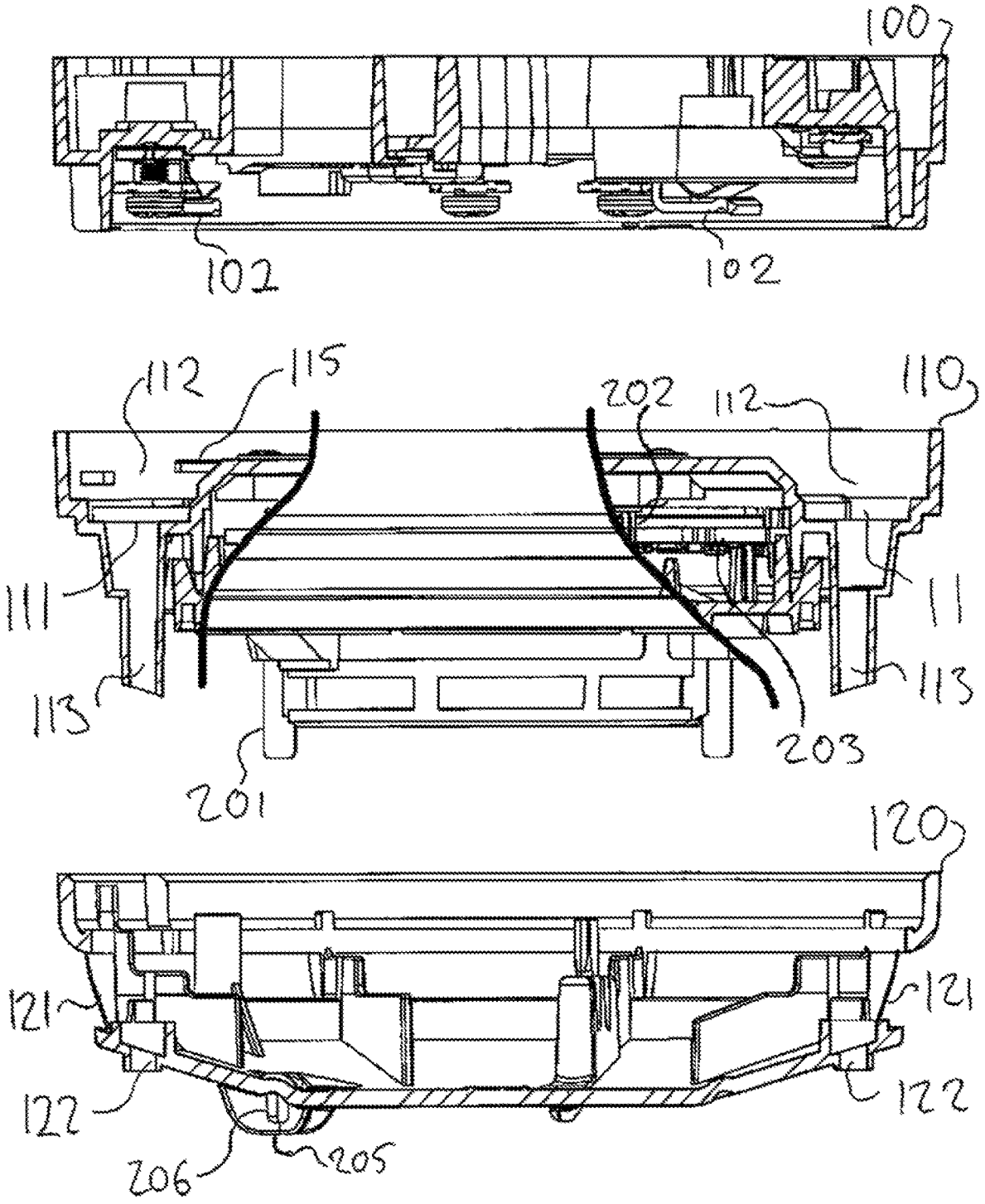
FIG. 2 is a cross-sectional view of a smoke or fire detector according to the present disclosure.

FIG. 2 shows an embodiment of the smoke or fire detector in cross section and in greater detail, separated into three principal parts: ceiling mount 100, detector housing part 110 and covering part 120.

Smoke or fire detection circuitry is provided (not shown), mounted on a printed circuit board (PCB) 203 which is mounted to a bottom surface of detector housing part 110 by PCB mount(s) 202. Electrical connection 115 is electrically connected to PCB 203.

When installed, connectors 102 may connect to a wired communication network (not shown) or to a power supply (not shown).

The PCB mount(s) 202 may be insulating spacers. Alternatively, they may be conductors providing electrical connection between electrical connectors 115 and PCB 203.

As can be seen, the conduits 113 take the form of elongate tubes or pipes. They fit into corresponding holes/recesses in the covering part 120, and the exhausts 122 form continuations of the conduits/pipes. In an alternative construction, the conduits/pipes 113 extend fully through holes in the covering part 120 to a position below the lower surface of the covering part 120.

The detection circuitry may comprise an optional sensor 201 which may be a heat sensor. When detector housing part 110 and covering part 120 are assembled, sensor 201 (if present) extends through a sensor aperture 206 out of a bottom surface of covering part 120. A cage or other protector 205 is shown covering sensor 201 to allow sensor 201 to be exposed to the environment below the detector and yet protect it from damage.

The above description has been given by way of example only and other arrangements, constructions and modifications can be make within the scope of the appended claims.

The invention claimed is:

1. A smoke or fire detector for mounting on a ceiling, comprising:

a first part for mounting on the ceiling;

a second part configured to be received by the first part, the second part housing a smoke or fire detecting means and comprising:

a top plate with a recess;

at least one electrical connection arranged above the recess;

at least one drain through a surface of the recess; and at least one conduit that extends downwards from the drain; and a third part, arranged to be received by and cover a lower surface of the second part and comprising:

at least one exhaust port on a bottom surface of the third part, the exhaust port arranged to receive the at least one conduit to provide venting for condensation and airflow below the third part and opposite the second part for the at least one conduit;

at least one opening for ingress of smoke or gas, wherein the at least one exhaust port is disposed radially inward from and below the at least one opening; and wherein the recess directs condensation to the at least one drain and into the at least one conduit, away from the electrical connection and the at least one exhaust port directs condensation and air flow away from the at least one opening.

2. The detector of claim 1, wherein the recess is an annular recess.

3. The detector of claim 1, wherein the first part has at least one first electrical connection for engaging the at least one electrical connection in the second part, wherein the at least one first electrical connection and the at least one second electrical connection make substantial contact with one another when the second part is received by the first part.

4. The detector of claim 3, wherein plastic interlocking elements provide fastening means for holding the first and second parts together.

5. The detector of claim 3, wherein the at least one first electrical connection and the at least one second electrical connection provide fastening means for holding the first and second parts together.

6. The detector of claim 5, wherein the at least one second electrical connection is connected to the smoke or fire detecting means.

7. The detector of claim 1, wherein the at least one conduit protrudes beyond the bottom surface of the third part.

8. The detector of claim 1, wherein the second part has a plurality of conduits.

9. The detector of claim 1 in which, when installed in a ceiling, the conduit(s) provide a route for air from above to vent out below the lower covering part, bypassing the detector.

10. A ceiling mountable smoke or fire detector, comprising:

a ceiling mount;

a detector housing to be received by the ceiling mount, the detector housing a smoke or fire detecting sensor and comprising:

a top plate with a recess;

at least one electrical connection arranged above the recess;

at least one drain through a surface of the recess; and at least one conduit that extends downwards from the drain;

a cover, arranged to be received by and cover a lower surface of the detector housing and comprising:

at least one smoke or gas inlet, wherein the at least one conduit is disposed radially inward from the at least one smoke or gas inlet; and at least one exhaust port on a bottom surface of the cover, the exhaust port arranged to receive the at least one conduit and the at least one conduit protrudes beyond the bottom surface of the cover;

wherein, when installed in a ceiling, the recess directs condensation and air from above to the at least one drain and into the at least one conduit, away from the electrical connection and the at least one smoke or gas inlet to vent condensation and air out below the cover.

11. The detector of claim 10, wherein the recess is an annular recess.

12. The detector of claim 10, wherein the ceiling mount has at least one first electrical connection engages the at least one electrical connection in the detector housing, wherein the at least one first electrical connection and the at least one second electrical connection make substantial contact with one another when the detector housing is received by the ceiling mount.

13. The detector of claim 12, wherein plastic interlocking elements hold the ceiling mount and detector housing together, or;

wherein the at least one first electrical connection and the at least one second electrical connection hold the ceiling mount and detector housing together, wherein the at least one second electrical connection is connected to the smoke or fire detecting sensor.

14. A ceiling mountable smoke or fire detector, comprising:

a ceiling mount;

a detector housing to be received by the ceiling mount, the detector housing including a smoke or fire detecting sensor and comprising:

a top plate with a recess;

at least one electrical connection arranged above the recess;

at least one drain through a surface of the recess, wherein the recess permits any condensation on a top surface of the device to build up in the recess below the level of the at least one electrical connection; and at least one conduit that extends downwards from the drain;

a cover, arranged to be received by and cover a lower surface of the detector housing and comprising:

at least one smoke or gas inlet, wherein the at least one conduit is disposed radially inward from the at least one smoke or gas inlet; and a bottom surface of the cover contains at least one exhaust port disposed radially inward from the at least one smoke or gas inlet, the at least one exhaust port arranged to receive the at least one conduit of the detector housing, the at least one exhaust port configured to provide venting for condensation and airflow below the cover and opposite the detector housing; and wherein the recess directs condensation to the at least one drain and into the at least one conduit, away from the electrical connection and the at least one opening to vent condensation and air out below the cover.

15. The detector of claim 14, wherein the recess is an annular recess.

16. The detector of claim 14, wherein the ceiling mount has at least one first electrical connection engages the at least one electrical connection in the detector housing, wherein the at least one first electrical connection and the at least one second electrical connection make substantial contact with one another when the detector housing is received by the first part.

17. The detector of claim 16, wherein plastic interlocking elements hold the ceiling mount and detector housing together, or;

wherein the at least one first electrical connection and the at least one second electrical connection hold the ceiling mount and detector housing together, wherein the at least one second electrical connection is connected to the smoke or fire detecting means.

18. The detector of claim 14, wherein the at least one conduit protrudes beyond the bottom surface of the cover and/or wherein the detector housing has a plurality of conduits, and when installed in a ceiling, the at least one conduit provides a route for air from above to vent out below the lower covering part, bypassing the detector.

* * * * *